US008077887B2

(12) United States Patent
Akino

(10) Patent No.: US 8,077,887 B2
(45) Date of Patent: Dec. 13, 2011

(54) ELECTRICAL CONNECTOR AND METHOD FOR MANUFACTURING A CONDENSER MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 380 days.

(21) Appl. No.: 12/385,324

(22) Filed: Apr. 6, 2009

(65) Prior Publication Data

US 2009/0262968 A1 Oct. 22, 2009

(30) Foreign Application Priority Data

Apr. 16, 2008 (JP) ..... 2008-106457

(51) Int. Cl.
*H04R 25/00* (2006.01)
*H01R 43/00* (2006.01)
*H01R 13/648* (2006.01)

(52) U.S. Cl. ..... 381/189; 29/825; 29/857; 439/607.02

(58) Field of Classification Search ..... None
See application file for complete search history.

(56) References Cited

U.S. PATENT DOCUMENTS

| | | | | |
|---|---|---|---|---|
| 3,496,500 | A * | 2/1970 | Romary | 335/205 |
| 2004/0198087 | A1 * | 10/2004 | Lin | 439/321 |
| 2006/0080831 | A1 * | 4/2006 | Nguyen et al. | 29/868 |
| 2006/0098835 | A1 * | 5/2006 | Akino | 381/369 |
| 2008/0175412 | A1 * | 7/2008 | Akino et al. | 381/111 |

* cited by examiner

*Primary Examiner* — Alonzo Chambliss
(74) *Attorney, Agent, or Firm* — Manabu Kanesaka

(57) ABSTRACT

There is provided an electrical connector especially suitable for a condenser microphone, which connector is, though being small in size, provided with an electromagnetic wave shielding unit that is capable of easily being installed in the connector and is equivalent to an EMI core. The electrical connector includes a cylindrical connector housing 10; a connector element 20; and a connection cable 30, and is configured so that the connector element 20 is supported on one end side of the connector housing 10, and the connection cable is drawn into the connector housing 10 through a cable insertion part 10*b* on the other end side of the connector housing 10 and thereby connected electrically to the connector element 20. In this electrical connector, a magnetic fluid 62, and a permanent magnet 61 for magnetically attracting the magnetic fluid 62 are housed in an excess space between the connector element 20 and the cable insertion part 10*b* in the connector housing 10.

7 Claims, 2 Drawing Sheets

ELECTRICAL CONNECTOR AND METHOD FOR MANUFACTURING A CONDENSER MICROPHONE

CROSS-REFERENCE TO RELATED APPLICATIONS

The present application is based on, and claims priority from, Japanese Application Serial Number JP2008-106457, filed Apr. 16, 2008, the disclosure of which is hereby incorporated by reference herein in its entirety.

TECHNICAL FIELD

The present invention relates to an electrical connector and a method for manufacturing a condenser microphone. More particularly, it relates to an electrical connector having means for shielding electromagnetic waves emitted from a cell phone or the like.

BACKGROUND ART

A microphone excluding a wireless microphone is used by being connected to the sound reproducing equipment side via a connection cable (microphone cable). A condenser microphone is usually supplied with electric power from a phantom power source via a microphone cable. As the microphone cable, a balanced two-core shield covered cable is used.

The condenser microphone is provided with a three-pin type output connector specified in EIAJ RC-5236 "Latch Lock Type Round Connector for Acoustic Equipment".

If the condenser microphone is used in an environment in which extraneous electromagnetic waves are present, a high-frequency current caused by the electromagnetic waves intrudes into a microphone case through the microphone cable and the output connector, and is detected by an impedance converter consisting of a field effect transistor (FET). In some cases, noise of an audio frequency level may be produced.

With the rapid spread of cell phones, chances of using a cell phone in the vicinity of a microphone have increased. The cell phone emits considerably strong electromagnetic waves (for example, in the range of several centimeters to several tens centimeters, the field strength thereof reaches several ten thousand times of the field strength developed in the city by commercial electric waves). Therefore, in the field of microphone, taking countermeasures against noise caused by electromagnetic waves emitted from cell phones is an urgent necessity.

As the countermeasures against noise of this kind, a method in which an EMI (Electro Magnetic Interference) core is used has been known. In the case where the EMI core is of a ring shape, the microphone is used by winding a part of the microphone cable on the EMI core several turns.

Also, a clamp type is also available in which, for example, a prismatic EMI core is halved, and the microphone cable is installed by inserting a part of the microphone cable therein. In any case, since the EMI core is large in size, the installation of the EMI core on the microphone cable is unfavorable in terms of appearance.

Apart from the above-described configurations, a method is also available in which ferrite beads are installed on signal cables in a connector as described in Patent Document 1 (Japanese Patent Application Publication No. H10-208818). However, in the case where the connector is small in size, and there is no room in the internal space, the ferrite beads cannot be installed in the connector.

Accordingly, an object of the present invention is to provide an electrical connector especially suitable for a condenser microphone, which connector is, though being small in size, provided with electromagnetic wave shielding means that is capable of easily being installed in the connector and is equivalent to an EMI core.

SUMMARY OF THE INVENTION

To achieve the above object, the present invention provides an electrical connector including a cylindrical connector housing; a connector element; and a connection cable, in which the connector element is supported on one end side of the connector housing, and the connection cable is drawn into the connector housing through a cable insertion part on the other end side of the connector housing and thereby connected electrically to the connector element, wherein a magnetic fluid, and a permanent magnet for magnetically attracting the magnetic fluid are housed in an excess space between the connector element and the cable insertion part in the connector housing.

According to the preferred mode of the present invention, the permanent magnet is formed into a ring shape through which the connection cable can be inserted, and is fixed with predetermined fixing means around the connection cable in the state in which the connection cable is inserted therethrough.

Also, the connector housing is formed with an injection hole for injecting the magnetic fluid into the excess space.

The present invention embraces a condenser microphone provided with the above-described electrical connector.

Also, the present invention embraces a method for manufacturing the above-described electrical connector. That is to say, the method for manufacturing the electrical connector in accordance with the present invention includes the steps of installing the permanent magnet formed into a ring shape on one end side of the connection cable connected to the connector element; arranging the one end side of the connection cable in the connector housing together with the permanent magnet; and injecting the magnetic fluid into an excess space between the connector element and the cable insertion part.

According to the present invention, by using the magnetic fluid as electromagnetic wave shielding means, even in a small connector, the electromagnetic wave shielding means can be provided easily in the connector. Also, since the magnetic fluid is attracted by the permanent magnet, there is no fear of leakage of magnetic fluid from the connector, so that the connector can be used for many years.

DETAILED DESCRIPTION

Figure 1:
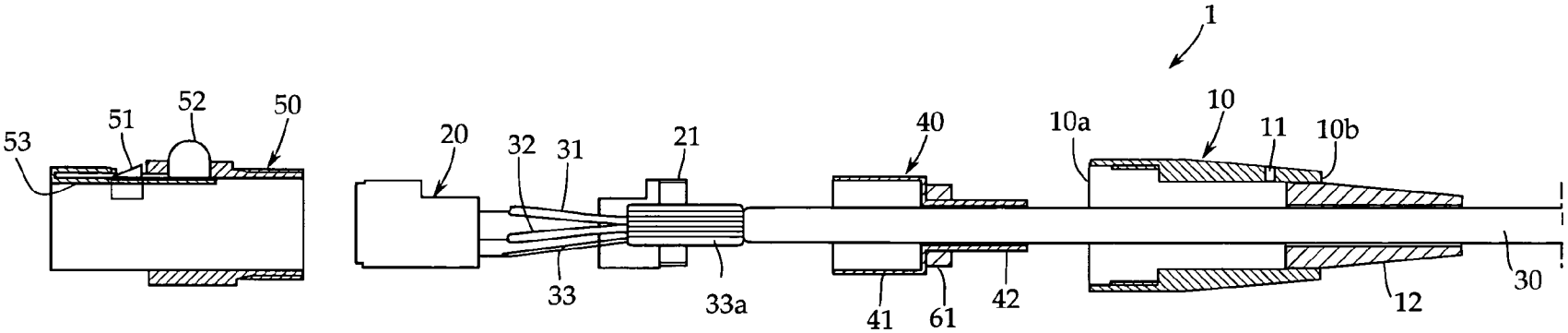
FIG. 1 is an exploded sectional view of an electrical connector in accordance with the present invention.
Figure 2:
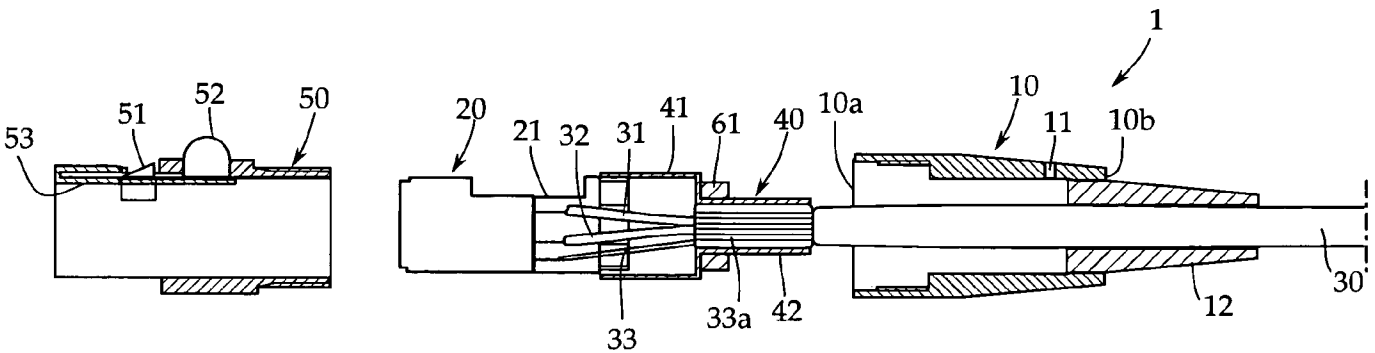
FIG. 2 is a sectional view showing an assembled state in a first process at the time of assembling.
Figure 3:
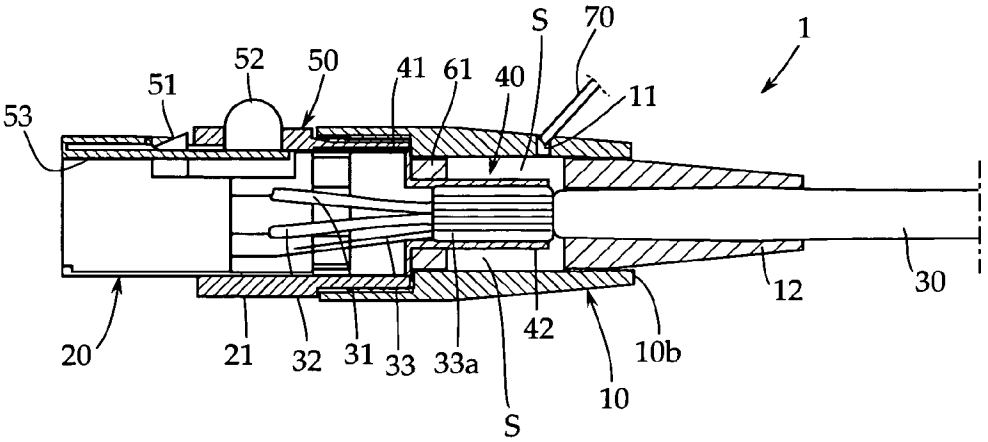
FIG. 3 is a sectional view showing an assembled state in a second process at the time of assembling.
Figure 4:
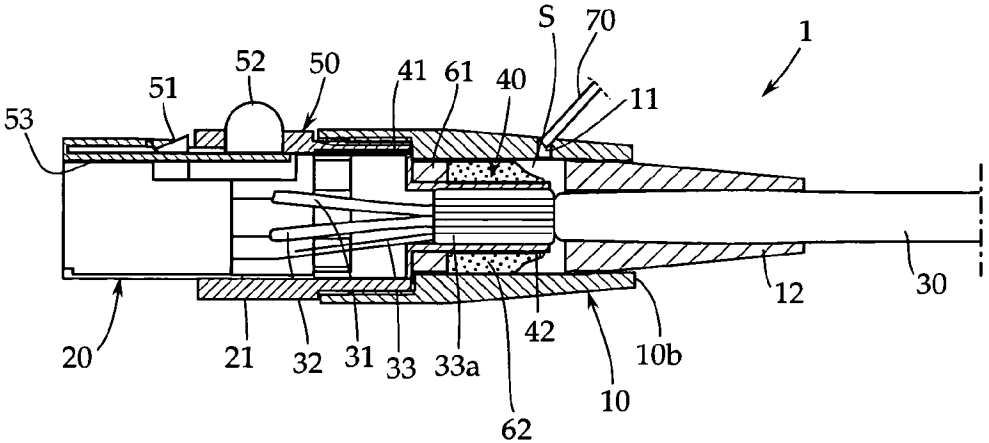
FIG. 4 is a sectional view showing an assembled state in a third process (final process) at the time of assembling.

An embodiment of the present invention will now be described with reference to FIGS. 1 to 4. The present invention is not limited to the embodiment. FIG. 1 is an exploded sectional view of an electrical connector in accordance with the present invention. FIG. 2 is a sectional view showing an assembled state in a first process at the time of assembling. FIG. 3 is a sectional view showing an assembled state in a second process. FIG. 4 is a sectional view showing an assembled state in a third process (final process).

In the explanation below, the electrical connector in accordance with this embodiment is called a microphone connector because it is used for a condenser microphone. The mating connector of this microphone connector is the aforementioned three-pin type output connector, not shown, provided on the condenser microphone side. If the output connector is of the socket side (female side), this microphone connector corresponds to the plug side (male side). As can see from the explanation below, the present invention can also be applied to the socket side.

As shown in FIG. 1, the microphone connector 1 includes a connector housing 10, a plug 20 serving as a connector element, and a microphone cable 30 as basic elements.

The connector housing 10, which is cylindrical, is preferably made of a metal such as brass alloy. At one end 10*a* of the connector housing 10, the plug 20 is arranged, and from a cable insertion part 10*b* on the other end side thereof, one end of the microphone cable 30 is pulled into the connector housing 10.

In the cable insertion part 10*b*, a cable bush 12 consisting of a rubber elastic body that is used usually can be fitted. In the present invention, in the peripheral wall of the connector housing 10, an opening 11 from which a magnetic fluid, described later, is injected into the connector housing 10 is formed.

Since the condenser microphone is connected to a phantom power source (both not shown), as the microphone cable 30, a balanced two-core shield covered cable is used. That is to say, the microphone cable 30 includes a signal hot-side core wire 31, a signal cold-side core wire 32, and a shielding cable 33.

In the plug 20, three contact terminals, not shown, are embedded. The hot-side core wire 31, the signal cold-side core wire 32, and the shielding cable 33 are connected to the corresponding contact terminals, respectively.

For the microphone cable 30 connected to the plug 20, the outer cover in the end part thereof is removed, and the shielding cable 33 is folded to the opposite side in a state of being exposed. In this specification, the portion in which the shielding cable 33 is folded to the outer cover side is called a shielding cable exposed part 33*a*.

In this embodiment, on one end side of the microphone cable 30, a coupler 21 fitted to the plug 20 is mounted. Also, in a portion in which the microphone cable 30 is drawn into the connector housing 10, a shield cup 40 made of, for example, an aluminum material is put.

The shield cup 40 includes a large-diameter cylindrical part 41 fitted on the coupler 21, and a small-diameter cylindrical part 42 in which the shielding cable exposed part 33*a* is inserted. The small-diameter cylindrical part 42 is fixed to the shielding cable exposed part 33*a* by staking. Also, on the outer periphery side of the small-diameter cylindrical part 42, a permanent magnet 61 formed into a ring shape is fitted.

Onto the plug 20, a plug cover 50 is attached. The plug cover 50 has a cylindrical shape having an inside diameter that is almost the same as the outside diameter of the plug 20, and the rear end side (the right end side in FIG. 1) thereof is fitted in the one end 10*a* of the connector housing 10.

Also, the plug cover 50 is provided with a locking claw 51 for locking the plug cover 50 to the not illustrated microphone case side and an operation knob 52 for releasing the locking. The locking claw 51 and the operation knob 52 are arranged on a plate spring 53 provided in the plug cover 50. Thereby, the locking claw 51 is urged by the plate spring 53 so as to project from the plug cover 50.

Therefore, the locking claw 51 acts as a latch lock claw, so that the locking is released by pressing the operation knob 52.

Next, one example of a method for assembling this microphone connector 1 is explained. As shown in FIG. 1, the microphone cable 30 is inserted into the connector housing 10, the outer cover on one end side of the microphone cable 30 is removed to expose the shielding cable 33, and the exposed portion is folded onto the outer cover to form the shielding cable exposed part 33*a*.

The shield cup 40 is put on the microphone cable 30, and the coupler 21 is mounted. The permanent magnet 61 is installed in advance to the small-diameter cylindrical part 42 of the shield cup 40. The permanent magnet 61 is preferably fixed with an adhesive or the like so as not to move. Then, the signal wires 31, 32 and the shielding cable 33 of the microphone cable 30 are connected to the corresponding contact terminals in the plug 20, respectively.

Next, as shown in FIG. 2, the coupler 21 is connected to the plug 20, the large-diameter cylindrical part 41 of the shield cup 40 is fitted to the outer periphery of the coupler 21, and the shield cup 40 is connected mechanically and electrically to the shielding cable exposed part 33*a* by staking the small-diameter cylindrical part 42.

Next, as shown in FIG. 3, the large-diameter cylindrical part 41 of the shield cup 40 is fitted to the one end 10*a* side of the connector housing 10 to attach the plug 20 to the connector housing 10. Thereafter, the plug cover 50 is put on the plug 20, and the rear end side of the plug cover 50 is inserted in the one end 10*a* of the connector housing 10.

Thereby, the microphone connector 1 is assembled in appearance. In the present invention, as shown in FIG. 4, a magnetic fluid 62 is injected into an excess space S (in this example, a space that is present around the small-diameter cylindrical part 42 of the shield cup 40) in the connector housing 10 through the opening 11 in the connector housing 10 by using an injection nozzle 70.

The injected magnetic fluid 62 is magnetically attracted by the permanent magnet, so that the injected magnetic fluid 62 does not leak out from the opening 11, and remains in the connector housing 10. Therefore, even if the microphone cable 30 is exposed to strong electromagnetic waves emitted from a cell phone or the like, the flow of a high-frequency current caused by the electromagnetic waves is inhibited by the magnetic fluid 62 in the connector housing 10. Thus, the magnetic fluid 62 brings about high-frequency current inhibiting action like an EMI core.

As one example of the magnetic fluid 62, a colloidal solution can be used which consists of ultrafine particles each having a diameter of about 10 nm, water, which is a principal component, a liquid (dispersion medium) such as an organic solvent or oil, and a surfactant for stably dispersing the particles in the liquid (dispersion medium) by adsorbing them.

The magnetic fluid of this kind is a reversible liquid that takes a liquid form when a magnetic field is not given, is turned to a solid form by magnetization when a magnetic field is applied by using a permanent magnet or the like, and returns to the liquid form when the magnetic field is kept away from the liquid.

According to the present invention, a high-frequency current caused by extraneous electromagnetic waves that are a noise source for the condenser microphone can be inhibited in the connector without mounting the EMI core on the microphone cable as in the conventional example. Also, since the magnetic material is a fluid, electromagnetic wave shielding means equivalent to the EMI core can be provided in the connector housing by utilizing a clearance in the connector housing.

In the above-described embodiment, a shield cup 40 is used as a preferable mode. However, in injecting the magnetic fluid 62 into the connector housing 10, the shield cup 40 is not necessarily needed.

In the case of mode where the shield cup 40 is not used, the permanent magnet 61 and the magnetic fluid 62 may be put in an excess space between the plug 20 and the cable insertion part 10*b* in the connector housing 10.

Also, the present invention can also be applied to an output connector (a three-pin type output connector specified in EIAJ RC-5236 "Latch Lock Type Round Connector for Acoustic Equipment") mounted on the condenser microphone.

The invention claimed is:

1. An electrical connector comprising:

a cylindrical connector housing;

a connector element supported on one end side of the connector housing;

a connection cable drawn into the connector housing through a cable insertion part on the other end side of the connector housing and connected electrically to the connector element:

a fixing device fixed around the connection cable inside the connector housing; and a magnetic fluid, and a permanent magnet for magnetically attracting the magnetic fluid, which are arranged in an excess space around the fixing device and between the connector element and the cable insertion part in the connector housing.

2. The electrical connector according to claim 1, wherein the permanent magnet is formed into a ring shape through which the connection cable is inserted, and is fixed with the fixing device.

3. The electrical connector according to claim 1, wherein the connector housing is formed with an injection hole for injecting the magnetic fluid into the excess space.

4. A condenser microphone comprising a microphone and the electrical connector attached to an end of the microphone, said electrical connector being described in claim 1.

5. The electrical connector according to claim 1, wherein the fixing device is a shield cap.

6. A method for manufacturing an electrical connector comprising:

preparing an assembly comprising a cylindrical connector housing; a connector element supported on one end side of the connector housing; a connection cable drawn into the connector housing through a cable insertion part on the other end side of the connector housing and connected electrically to the connector element: and a fixing device to be fixed around the connection cable inside the connector housing;

installing a permanent magnet formed into a ring shape around the fixing device on one end side of the connection cable connected to the connector element;

arranging the one end side of the connection cable in the connector housing together with the permanent magnet; and injecting a magnetic fluid into an excess space around the fixing device and between the connector element and the cable insertion part.

7. The method of manufacturing an electrical connector according to claim 6, wherein the fixing device is a shield cap.

* * * * *